US006481070B2

(12) United States Patent
Caeran et al.

(10) Patent No.: US 6,481,070 B2
(45) Date of Patent: Nov. 19, 2002

(54) FASTENING STRAP FOR SPORTS SHOES

(75) Inventors: Francesco Caeran, Montebelluna (IT); Mario Gonella, Conegliano (IT)

(73) Assignee: Benetton Group S.p.A., Ponzano Veneto (IT)

( * ) Notice: Subject to any disclaimer, the term of this patent is extended or adjusted under 35 U.S.C. 154(b) by 0 days.

(21) Appl. No.: 09/906,720

(22) Filed: Jul. 18, 2001

(65) Prior Publication Data

US 2002/0010987 A1 Jan. 31, 2002

(30) Foreign Application Priority Data

Jul. 28, 2000 (IT) ..... TV00A0089

(51) Int. Cl.[7] ..... A43B 11/00

(52) U.S. Cl. ..... 24/712; 24/16 PB; 24/68 SK; 36/50.1

(58) Field of Search ..... 24/712, 712.4, 24/715.3, 68 SK, 69 SK, 70 SK, 71 SK; 36/50.1, 117.1, 51, 52

(56) References Cited

U.S. PATENT DOCUMENTS

| | | | | | |
|---|---|---|---|---|---|
| 1,635,884 | A | * | 7/1927 | Gilewicz | 24/712 X |
| 5,148,614 | A | * | 9/1992 | Kelly | 36/50.1 |
| 5,459,907 | A | * | 10/1995 | Nivet | 24/484 |
| 5,526,585 | A | * | 6/1996 | Brown et al. | 36/50.1 |
| 5,745,959 | A | * | 5/1998 | Dodge | 24/68 SK |
| 5,894,640 | A | * | 4/1999 | Dewey | 24/306 |
| 6,138,327 | A | * | 10/2000 | Powell et al. | 24/16 PB |
| 6,250,651 | B1 | * | 6/2001 | Reuss et al. | 280/14.21 |

* cited by examiner

*Primary Examiner*—Robert J. Sandy
(74) *Attorney, Agent, or Firm*—Guido Modiano; Albert Josif; Daniel O'Byrne

(57) ABSTRACT

A fastening strap for sports shoes, particularly for in-line skates, comprising at least two elements made of materials having mutually different rigidities. This allows better adaptation to the outer shape of the shoe and eliminates pressure points, particularly on the bony regions of the leg.

6 Claims, 2 Drawing Sheets

FASTENING STRAP FOR SPORTS SHOES

BACKGROUND OF THE INVENTION

The present invention relates to a fastening strap for sports shoes such as ski boots, roller skates, ice skates, ice boots and trekking boots.

Currently, sports shoes, such as ski boots, roller skates, ice skates, ice boots or trekking boots, are substantially constituted by a shell and by at least one quarter, both made of rigid materials, for example by injecting thermoplastic material. The thermoplastic material is used to allow optimum transmission of the efforts of the leg and foot, while comfort is provided by using a soft innerboot or an insole also made of soft material.

Such sports shoes also require the use of suitable levers for closing the flaps of the shell and of the quarter. A typical lever comprises, for example, a lever arm articulated between two shoulders that protrude from a base which is associated with a first flap, a rigid connection element being associated with the lever arm and being constituted for example by a toothed strap which is made of plastics, is associated with the other flap to be joined and can selectively engage a pawl which is associated with the lever arm at one of the teeth formed in the strap.

A lever of this type is disclosed, for example, in the Italian utility model application No. 61949 B/78, filed on Dec. 15, 1978.

These straps allow to achieve a closure of the rigid and non-deformable type, but have the great drawback of being unable to adapt to the outer shape of the shoe, thus producing regions of higher and lower pressure, with a consequent decrease in the degree of comfort for the user. Moreover, in the regions not affected by the plastic components (shell or quarter), the direct interaction of the rigid strap with the innerboot produces pressure points, particularly on the bony regions of the leg.

SUMMARY OF THE INVENTION

The aim of the present invention is to solve the noted technical problems, eliminating the drawbacks of the cited prior art, by providing a fastening strap for sports shoes which ensures optimum closure of the shoe and at the same time allows to increase user comfort during use of the shoe.

Within this aim, an important object is to provide a fastening strap for sports shoes which allows to eliminate pressure points, particularly on the bony regions of the leg.

Another important object is to provide a fastening strap for sports shoes which is structurally simple as well as reliable and safe in use.

This aim and these and other objects which will become better apparent hereinafter are achieved by a fastening strap for sports shoes, characterized in that it comprises at least two elements made of materials having mutually different rigidities.

BRIEF DESCRIPTION OF THE DRAWINGS

Further characteristics and advantages of the fastening strap according to the invention will become better apparent from the detailed description of a particular but not exclusive embodiment, illustrated only by way of non-limitative example in the accompanying drawings, wherein.

DESCRIPTION OF THE PREFERRED EMBODIMENTS

Figure 1:
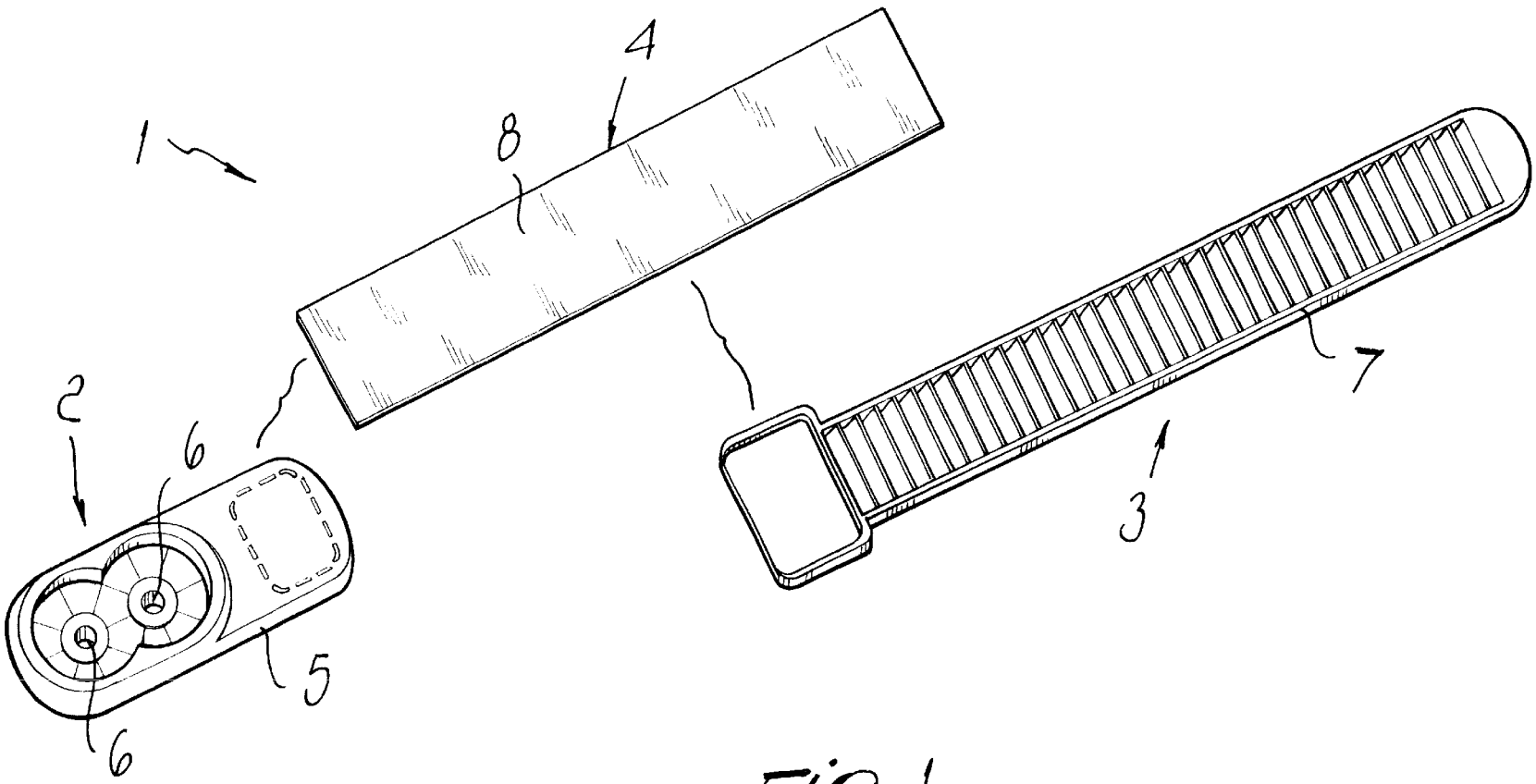
FIG. 1 is an exploded perspective view of the strap according to the invention.
Figure 3:
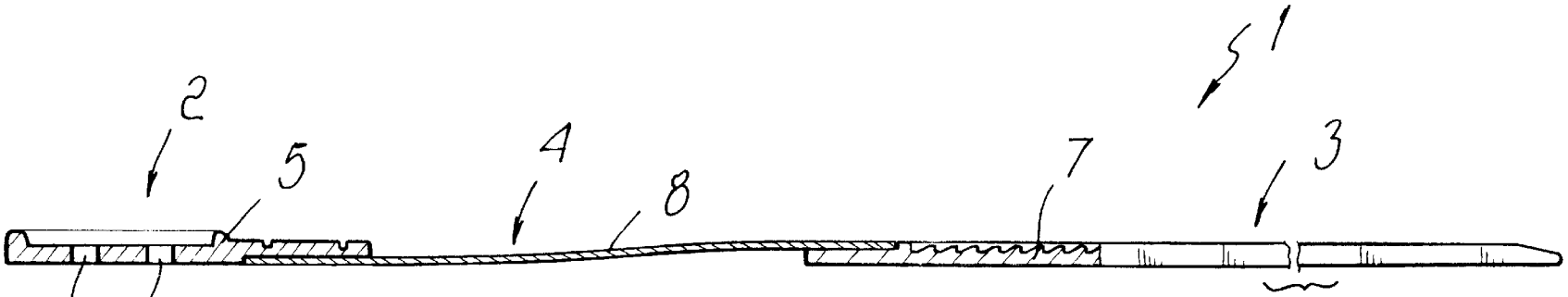
FIG. 3 is a longitudinal section view of the strap.
Figure 2:
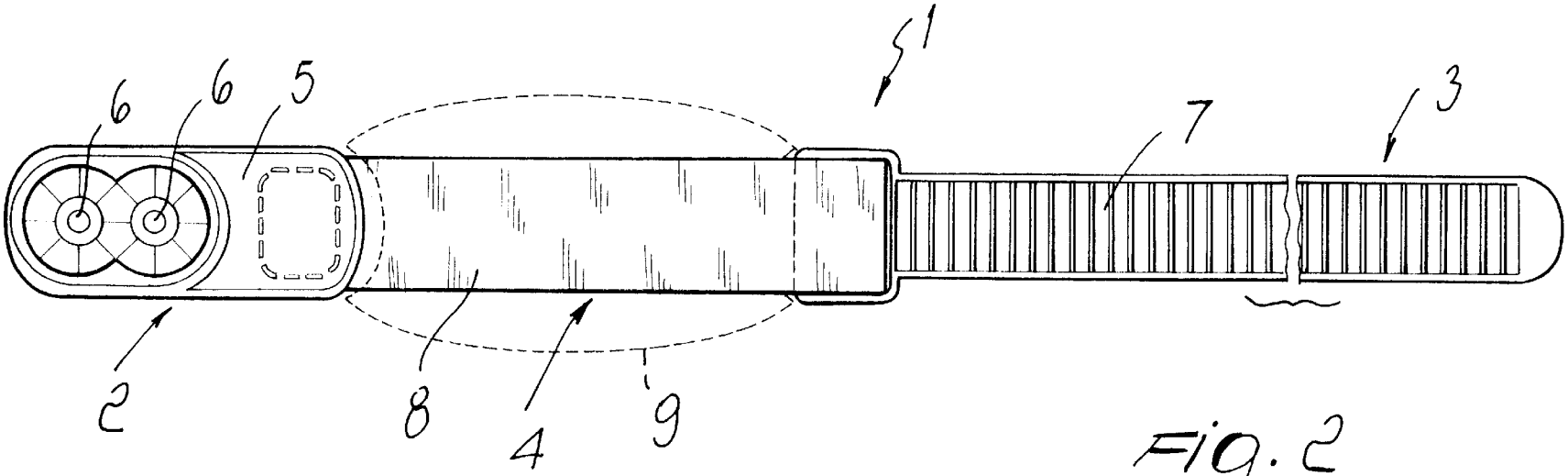
FIG. 2 is a plan view of the strap.

With reference to the figures, the numeral 1 designates a fastening strap which is used particularly in sports shoes such as, for example, ski boots, roller skates, ice skates, ice boots or trekking boots.

The fastening strap is constituted by at least two elements made of materials having mutually different rigidities. In the illustrated embodiment, a first element 2 and a second element 3 are made of a rigid material, such as for example metal or plastics, and a third element 4, which is interposed between the preceding ones, is made of a soft material.

The first element 2 is constituted, for example, by a plate 5 which is associated at a first flap of the shoe, for example by means of rivets or screws. In this case, one or more holes 6 are provided in the plate 5.

The second element 3 can be constituted, for example, by a toothed strap 7 which interacts with an engagement device associated with the other flap to be joined.

The third element 4, made of soft material, is interposed between the first rigid element and the second rigid element and is also stably connected thereto for example by means of stitched seams, adhesive, studs, rivets, thermal bonding, overmolding, or other methods.

The third element 4 can be constituted for example by a band 8 made of fabric being optionally covered by an element 9 which has protective functions in order to further reduce pressure points on the leg or cushion any impacts on the leg, avoid accidental lacerations or allow to apply thereto markings and/or other aesthetic decorations.

The element 9 is of course also made of soft material and provided with a padding.

It has been observed that the invention has achieved the intended aim and objects, since the fastening strap thus provided allows, in sports shoes, to improve user comfort during sports practice, since the first rigid element and the second rigid element are used for connection to a flap and to an engagement device which is associated with the other flap, and the third soft element can thus affect the front part of the leg or the upper metatarsal region, adapting perfectly to the underlying shoe, thereby reducing the pressure applied to the corresponding region of the. leg and of the foot, particularly at the respective bony regions where the fastening action is applied.

The dimensions of the first, second and third elements are in fact such that the third soft element affects regions, for example the upper metatarsal region or the front region of the tibia of the user's leg, not affected by the rigid flaps of the shell or quarter, so as to allow the user to maintain the degree of tension and closure of the shoe unchanged, adapting perfectly thereto and avoiding the generation of pressure points on the foot or on the leg caused by the overlap of multiple layers of rigid or semirigid materials.

The fastening strap according to the invention is also structurally simple and can be manufactured by means of conventional machines and equipment.

What is claimed is:

1. A fastening strap for sports shoes, comprising at least two elements made of materials having mutually different rigidities, and comprising a first clement and a second element made of rigid material, a third element made of soft material, being interposed between said first and second elements made of rigid material.

2. The strap according to claim 1, wherein said first and second elements are made of metal or plastics.

3. The strap according to claim 1, wherein said third element is made of soft material is interposed between said first and second rigid elements and is stably connected thereto.

4. The strap according to claim 3, wherein said additional soft element constitutes a protection means in order to further reduce the pressure points on a user's leg and a means for cushioning any impacts on a user's leg.

5. A fastening strap for sports shoes, comprising at least two elements made of materials having mutually different rigidities, and comprising a first element and a second element made of rigid material, said first element being constituted by a plate which is rigidly associated with a first flap of the shoe.

6. A fastening strap for sports shoes, comprising at least two elements made of materials having mutually different rigidities, and comprising a first element and a second element made of rigid material, said second element being constituted by a toothed band which interacts with an engagement device being associated with the other flap to be joined.

* * * * *